US007340194B2

(12) United States Patent
Ozawa

(10) Patent No.: US 7,340,194 B2
(45) Date of Patent: Mar. 4, 2008

(54) SYSTEM FOR ASSOCIATING IMAGES PRODUCED BY AN IMAGE FORMING APPARATUS WITH USERS OF THE APPARATUS

(75) Inventor: Junichi Ozawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 98 days.

(21) Appl. No.: 11/068,959

(22) Filed: Mar. 2, 2005

(65) Prior Publication Data

US 2005/0214016 A1 Sep. 29, 2005

(30) Foreign Application Priority Data

Mar. 17, 2004 (JP) ..... P.2004-077090

(51) Int. Cl.
*G03G 21/02* (2006.01)

(52) U.S. Cl. ..... 399/79

(58) Field of Classification Search ..... 399/79, 399/80, 82, 75

See application file for complete search history.

(56) References Cited

U.S. PATENT DOCUMENTS 5,610,688 A * 3/1997 Inamoto et al. ..... 399/366

FOREIGN PATENT DOCUMENTS

| | | |
|---|---|---|
| JP | 08-084251 | 3/1996 |
| JP | 09-023333 | 1/1997 |
| JP | 11-075051 | 3/1999 |

OTHER PUBLICATIONS

Computer translation of JP11-075051a.*

* cited by examiner

*Primary Examiner*—Quana Grainger
(74) *Attorney, Agent, or Firm*—Morgan, Lewis & Bockius LLP

(57) ABSTRACT

An image generation managing system includes an image forming apparatus provided in a management target area to form a color image on a recording medium, an image capturing apparatus to capture an image in a vicinity of the image forming apparatus in the management target area, and a job management device connected to the image forming apparatus and the image capturing apparatus over a network to data-communicate therewith to manage an image generating job by the image forming apparatus. Preferably, the image forming apparatus includes a specific pattern imparting unit to impart a specific pattern specifying an image formed for each image generating job by the image forming apparatus, and the job management device includes a database in which the specific pattern information and the image data captured are stored in a state they can be associated to each other and from which the stored information is freely retrieved.

16 Claims, 11 Drawing Sheets

FIG. 8

| TIME FLOW | EXTERNAL INFORMATION PROCESSING CENTER | | | |
|---|---|---|---|---|
| | DATA PROCESSING SYSTEM | STORAGE SYSTEM (DB) | | |
| | | STORAGE AREA 1 | STORAGE AREA 2 | STORAGE AREA 3 | STORAGE AREA 4 |
| | | STORE (AV) | | | |
| | | | | | |
| | | | | | STORE ASSOCIATION INFO. FILE (D) |
| | | | | | |
| | | | | | |
| | RECEIVE COPY START SIGNAL | | | | |
| | STORE CURRENT TIME (Ta) | | | | |
| | | | | | |
| | | | | | |
| | | | | | |
| | | | | | |
| | | | | | |
| | | | | | |
| | | | | | |
| | | | | | |
| | | | | | |
| | | | | | |
| | | | | | |
| | RECEIVE SPECIFIC PATTERN INFO. | | | | |
| | MAKE SPECIFIC PATTERN INFORMATION INTO FILE (A) | | | | |
| | STORE FILE (A) IN STORAGE AREA 2 | | | | |
| | | | STORE FILE (A) | | |
| | | | | | |
| | RECEIVE COPY TERMINATION SIGNAL | | | | |
| | STORE CURRENT TIME (Tb) | | | | |
| | | | | | |
| | m SECONDS ELAPSED | | | | |
| | | | | | |
| | ACQUIRE CAPTURED MOVING PICTURE (AV) CORRESPONDING TO TIME FROM (Ta - n) TO (Tb + m) FROM STORAGE AREA 1 | | | | |
| | COMPRESS (AV) IN MPEG 2 FORMAT | | | | |
| | STORE (MP) IN STORAGE AREA 3 | | | | |
| | | | | STORE FILE (MP) | |
| | ADDITIONALLY WRITE ON ASSOCIATION INFORMATION FILE (D) THAT (A) AND (MP) ARE ASSOCIATED TO EACH OTHER | | | | UPDATE (D) |
| | | | | | STORE UPDATED (D) |

SYSTEM FOR ASSOCIATING IMAGES PRODUCED BY AN IMAGE FORMING APPARATUS WITH USERS OF THE APPARATUS

BACKGROUND OF THE INVENTION

1. Field of the Invention

The present invention relates to an image generation managing system to manage an image generating job by an image forming apparatus, and more particularly, to an image generation managing system capable of managing the image generating job by the image forming apparatus that many and unspecified persons can use and effectively preventing an abuse of the image forming apparatus.

2. Description of the Related Art

In recent years, image forming apparatuses, such as duplicating machines or printers, have rapidly progressed toward high-quality color images. This rapid progress of the image forming apparatus causes specific documents that should not be counterfeited, such as securities and paper money, to be easily copied.

In order to prevent such a forgery of the securities, and the like, there has been disclosed a method of adding a specific pattern (for example, a yellow dot pattern) imperceptible by human eyes to an image output from an image forming apparatus, of performing a follow-up survey on the specific pattern to specify the image forming apparatus related to forgery, and of specifying a user related to the forgery, for example, the owner of the image forming apparatus (for example, see JP-A-11-75051 (FIG. 3)).

Further, this type of method of adding the specific pattern has been schematically disclosed in JP-A-11-75051 (FIG. 13) and JP-A-9-23333 (FIG. 15).

Recently, an image forming apparatus, such as a color duplicating machine, has been provided in, for example, a convenience store for the convenience of users.

However, since many and unspecified persons use the image forming apparatus provided in the convenience store, it is difficult to specify which user abuses the image forming apparatus to counterfeit, for example, securities. Therefore, it is strongly demanded to strengthen a preventive measure against the forgery of the securities, etc.

SUMMARY OF THE INVENTION

The present invention is designed to solve the above technical problems, and the present invention provides an image generation managing system capable of effectively preventing a user from using an image forming apparatus for an improper purpose even when the image forming apparatus is provided at a place where many and unspecified persons can use it.

According to an aspect of the present invention, an image generation managing system includes an image forming apparatus provided in a management target area to form a color image on a recording medium, an image capturing apparatus to capture an image in a vicinity of the image forming apparatus in the management target area, and a job management device connected to the image forming apparatus and the image capturing apparatus over a network to data-communicate therewith, to manage an image generating job by the image forming apparatus. Preferably, the image forming apparatus includes a specific pattern imparting unit to impart a specific pattern specifying an image formed for each image generating job by the image forming apparatus, and the job management device includes a database in which specific pattern information imparted to the image by the specific pattern imparting unit and image data captured by the image capturing apparatus are stored in a state in which they can be associated to each other and from which the stored information is freely retrieved.

BRIEF DESCRIPTION OF THE DRAWINGS

Embodiments of the present invention will be described in detail based on the following figures, wherein:

FIG. 5B is an explanatory view illustrating an example of a specific pattern of the image;

FIG. 8 is an explanatory view illustrating a data processing system and a storage system of an external information processing center according to the first embodiment;

DETAILED DESCRIPTION OF THE INVENTION

Figure 1:
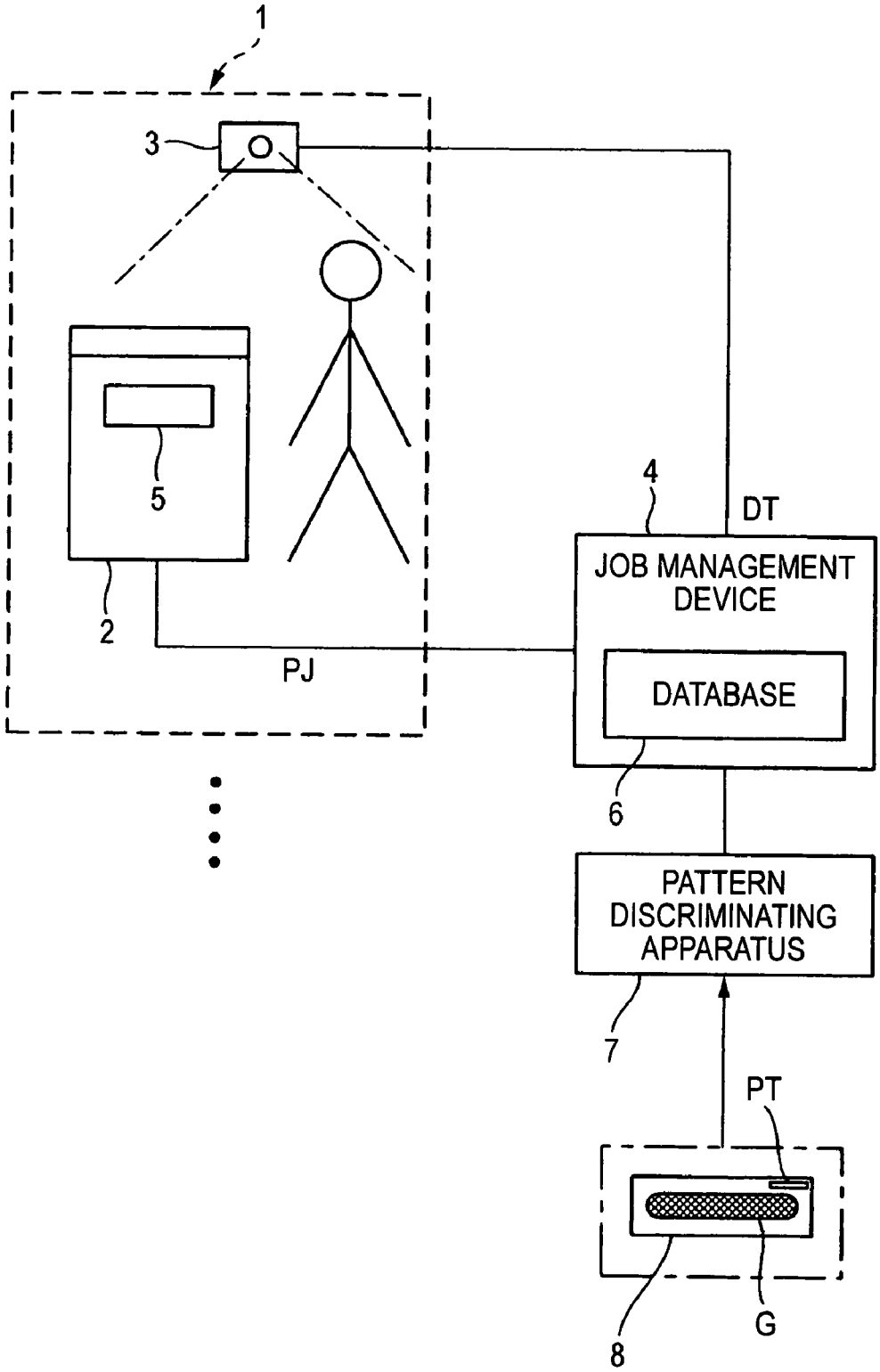
FIG. 1 is a view illustrating the outline of an image generation managing system according to the present invention.

That is, as shown in FIG. 1, the present invention provides an image generation managing system including an image forming apparatus 2 provided in a management target area 1, to form a color image (hereinafter, referred to as an image, if necessary) G on a recording medium 8, an image capturing apparatus 3 to capture an image in the vicinity of the image forming apparatus 2 in the management target area 1, and a job management device 4 connected to the image forming apparatus 2 and the image capturing apparatus 3 over a network to data-communicate therewith and managing an image generating job by the image forming apparatus 2, wherein the image forming apparatus 2 includes a specific pattern imparting unit 5 to impart a specific pattern PT specifying an image G formed for each image generating job by the image forming apparatus 2, and the job management device 4 includes a database 6 in which specific pattern information PJ imparted to the image G by the specific pattern imparting unit 5 and image data DT captured by the image capturing apparatus 3 are stored in a state in which they can be associated to each other and from which the stored information is freely retrieved.

In such a technical means, the present invention makes it possible to manage the image generating job by the image forming apparatus 2 provided in, for example, the convenience store and to effectively cope with an illegal image generating job (for example, forgery of securities).

Here, the management target area 1 indicates, for example, the convenience store or each post in a company, and the plural image forming apparatuses 2 are provided in one management target area 1. In this case, the image forming apparatuses 2 may be separately managed.

Further, a color duplicating machine is generally considered as the image forming apparatus 2. However, a compound machine having various functions, such as a color printer function and a color facsimile function, is also used as the image forming apparatus 2.

Furthermore, an apparatus, such as a monitoring camera, is generally considered as the image capturing apparatus 3. However, if it has an image capturing function, any apparatus can be used as the image capturing apparatus 3 regardless of a stationary type or a movable type. In addition, for the number of the image capturing apparatus 3, at least one image capturing apparatus 3 may be provided with respect to one image forming apparatus 2 of the management target area 1, preferably, the plural image capturing apparatuses 3 may be provided with respect to one image forming apparatus 2 of the management target area 1. In this case, it is possible to capture images in the vicinity of the image forming apparatus 2 at various angles.

Moreover, any apparatus capable of managing the image generating job of the image forming apparatus 2 provided in the management target area 1 can be used as the job management device 4. The job management device 1 may be provided inside or outside the management target area 1. When plural image forming apparatuses 2 are provided in plural management target areas 1, it is preferable that the job management device 4 be provided outside each management target area 1 to unitarily manage the image generating jobs by the plural image forming apparatuses 2, from the viewpoint of managing the image generating job by each image forming apparatus 2.

Further, the job management device 4 may be provided in the management target area 1 separately from the image forming apparatus 2, which is a management target, or may be incorporated into the image forming apparatus 2. Particularly, when the job management device 4 is incorporated into the image forming apparatus 2, it is possible to manage the image generating job for each management target area 1 in a small space.

Furthermore, the image forming apparatus 2 needs to have a specific pattern imparting unit 5 to impart a specific pattern PT specifying the image G formed for each image generating job by the image forming apparatus 2.

This specific pattern PT can be used for various purposes. However, from the viewpoint of preventing forgery of securities, etc., it is preferable that information on the source of the image G or the formation date of the image G, for example, be imparted as the specific pattern PT.

Here, the specific pattern PT is preferably a dot pattern (yellow dot pattern) that is not perceived or hardly perceived by human eyes. In this case, it is possible to settle a problem in that the quality of the image G deteriorates when the image G is perceived by the human eyes.

Further, it is preferable that different specific patterns PT be respectively added to the images output from all the image forming apparatuses 2, which are management targets. According to this configuration, it is possible to directly and exclusively relate the specific pattern PT with the image G.

Furthermore, the specific pattern PT preferably includes source information specifying the image forming apparatus 2 in use and time information specifying the time of the image generating job. In this way, it is possible to perform temporal and spatial specifications of the image generating job by the image forming apparatus 2.

Moreover, it is necessary for the job management device 4 to have a database 6 to store information.

The database 6 is preferably stored with information (specific pattern information PJ) corresponding to the specific pattern PT imparted to the image G by the specific pattern imparting unit 5 and the image data DT captured by the image capturing apparatus 3 such that they are associated to each other.

Here, the term 'the specific pattern information PJ and the image data DT are associated to each other' includes a case in which relating them is performed at a point of time when the specific pattern 6 is found. The database 6 is preferably stored with the specific pattern information PJ of the image G and the image data DT in a state in which they have been previously associated to each other. In this way, it is possible to rapidly perform a retrieving process by previously relating the specific pattern information PJ to the image data DT.

Further, the image data DT stored in the database 6 preferably is an image in the vicinity of the image forming apparatus 2 captured by the image capturing apparatus 3, or may be an image obtained by photographing the image capturing apparatus 2 and the vicinity thereof. In this case, since the user's scope of action is limited to the vicinity of the image forming apparatus 2 at the time of the image generating job, it is possible to effectively specify the user of the image forming apparatus 2.

Furthermore, the image data DT preferably includes image data captured when the image forming apparatus 2 is in use. In this way, it is possible to effectively specify the user performing the image generating job.

Meanwhile, the image data DT preferably includes image data captured before or after the image forming apparatus 2 is used. In this case, since the user is always present before or after the image generating job is performed, it is possible to effectively specify the user. In addition, the range of time before or after the use of the image forming apparatus can be properly set. For example, the time is preferably selected in the range of 0 to 90 seconds in order to reduce storage capacity.

Further, the storage format of the image data DT is properly selected. For example, it is preferable that the image data DT captured by the image capturing apparatus 3 be stored in the database 6 in a compressed file format in order to reduce the storage capacity. Here, various formats, such as MPEG 1, MPEG 2, and MPEG 4, can be used as the compressed file format.

Furthermore, a method of determining a storage range of the image data DT by the job management device 4 is properly selected. As a representative aspect, the storage range of the image data DT captured by the image capturing apparatus 3 is determined based on the image generation start timing (for example, an image generation start signal functions as a trigger) of the image forming apparatus 2.

Moreover, in order to effectively use the storage capacity of the database 6, the job management device 4 selects necessary portions of the image data DT to create it as a file (hereinafter, referred to as a 'necessary file') and stores the necessary file in the database 6. Then, the job management device 4 removes unnecessary image data DT from the database 6.

In the present embodiment, the necessary file means a portion (still image) or all (moving picture) of the image data DT corresponding to the specific pattern information PJ of the image G. Meanwhile, the unnecessary image data DT means some of the image data DT transmitted from the image capturing apparatus 3 other than the necessary file, regardless of the specific pattern information PJ. In addition, the unnecessary files can be removed from the image data DT at any time after the necessary files are stored.

Further, as a representative aspect of relating the specific pattern information PJ of the image G with the image data DT, a file name of the image data DT may be associated to the specific pattern information PJ of the image G to discriminate the image data, or information associated between the specific pattern information PJ of the image G and the image data DT may be stored.

Furthermore, in order to perform a follow-up survey when counterfeit securities are found, it is preferable that the image generation managing system include a pattern discriminating apparatus 7 to discriminate the specific pattern PT added on the image G on the recording medium 8, and retrieve the database 6 by the job management device 4, based on the specific pattern PT discriminated by the pattern discriminating apparatus 7. Any device capable of discriminating the specific pattern PT can be used as the pattern discriminating apparatus 7. For example, a device capable of extracting the specific pattern PT from the information read by, for example, a scanner may be used as the pattern discriminating apparatus 7.

According to the present invention, an image capturing apparatus is provided with respect to an image forming apparatus in a management target area, and a job management device is provided so as to communicate with the image forming apparatus and the image capturing apparatus. In addition, the image forming apparatus is provided with a specific pattern imparting unit, and the job management device is provided with a database in which specific pattern information of an image and captured image data are stored in a state in which they are associated to each other and from which the stored information is freely retrieved. In this way, it is possible to reliably retrieve image information corresponding to the specific pattern information, and thus it is possible to reliably specify the image generating job of a user by an image forming apparatus when the specific pattern has been added.

Therefore, even when the image forming apparatus is provided at a place where many and unspecified persons can use it, it is possible to specify the image generating job of the user by the image forming apparatus, based on the specific pattern information added to an image on a recording medium. Accordingly, it is possible to reliably manage the image generating job of the image forming apparatus which can be used by many and unspecified persons. Thus, the present invention is very effective in preventing the improper use of the image forming apparatus.

Particularly, in the present invention, since the pattern discriminating apparatus is provided to discriminate a specific pattern added to an image on a recording medium, it is possible to discriminate the specific pattern added to the image on the recording medium and to rapidly retrieve image information corresponding to the specific pattern. Thus, it is possible to more reliably manage the image generating job of an image forming apparatus that can be used by many and unspecified persons.

Hereinafter, preferred embodiments of the present invention will be described with reference to the accompanying drawings.

First Embodiment

Figure 2:
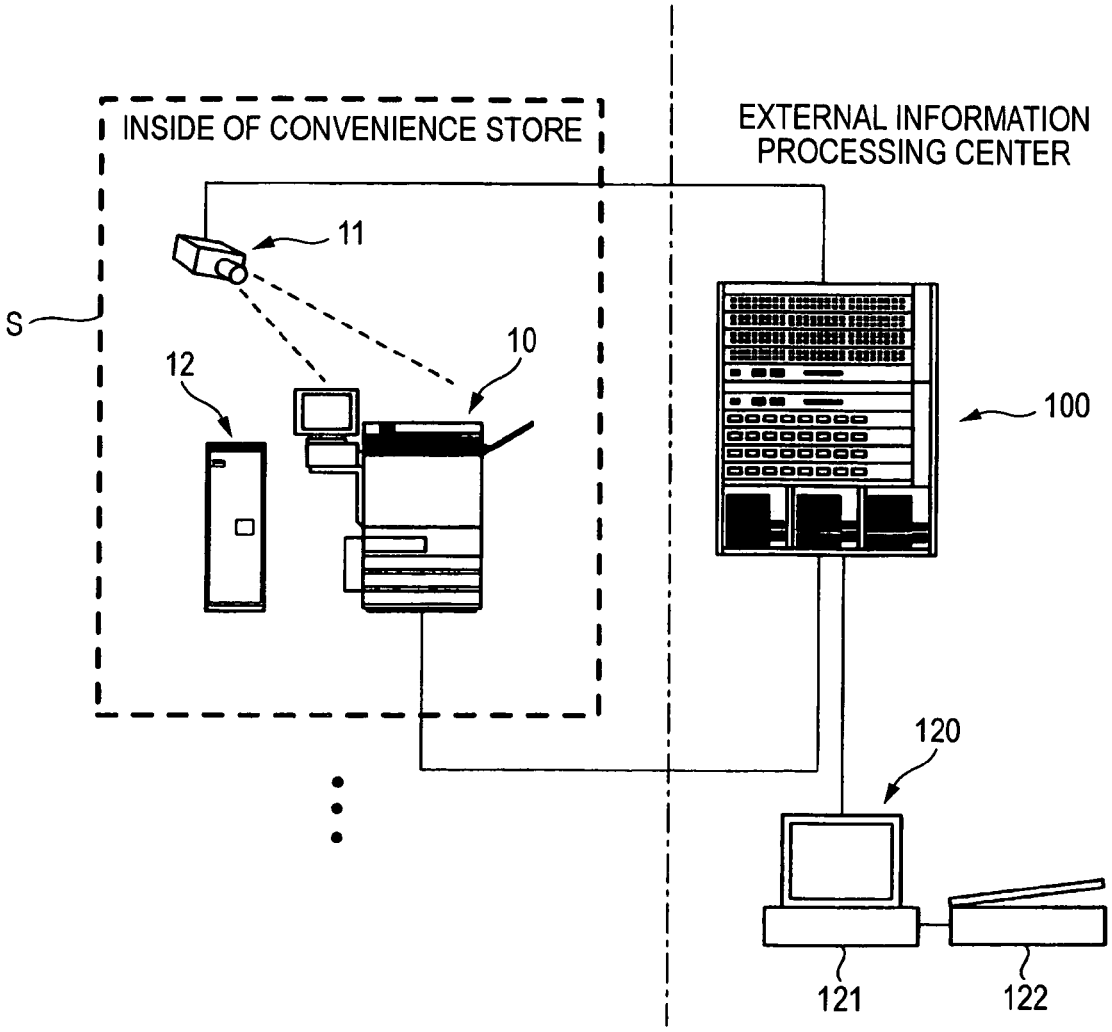
FIG. 2 is an explanatory view illustrating a first embodiment of the image generation managing system according to the present invention.

FIG. 2 is a view illustrating an overall structure of a first embodiment of an image generation managing system according to the present invention.

In the image generation managing system shown in FIG. 2, an external information processing center C manages image generating jobs of image forming apparatuses 10 respectively provided in plural management target areas S.

More specifically, for example, a convenience store, which is one of the management target areas S, is provided with the image forming apparatus 10 composed a color duplicating machine that can be used by many and unspecified users, and a monitoring camera 11 is provided in the vicinity of the image forming apparatus 10.

The monitoring camera 11 can be provided to monitor the vicinity of the image forming apparatus 10, and preferably to monitor the image forming apparatus 10 and the vicinity thereof in order to specify a user of the image forming apparatus 10. Further, it is preferable to provide one or more monitoring cameras 11. However, in order to accurately grasp peripheral circumstances of the image forming apparatus 10, plural monitoring cameras 11 may be provided in the vicinity of the image forming apparatus 10 to monitor the periphery of the image forming apparatus 10 at various angles. Furthermore, an image captured by the monitoring camera 11 to photograph positions separated from the image forming apparatus 10, for example, the vicinity of an entrance of the convenience store, may be used complementarily.

Further, reference numeral 12 indicates a money input device for the image forming apparatus 10.

Meanwhile, a central management apparatus 100 is provided in the external information processing center C, and the central management apparatus 100 is connected to the monitoring cameras 11 and the image forming apparatuses 10 in the respective management target areas S over a network so as to communicate therewith, so that necessary information (a copy start signal, a copy termination signal, and specific pattern information, which will be described later) from the image forming apparatuses 10 and image data from the monitoring cameras 11 can be transmitted to the central management apparatus 100.

Further, a pattern discriminating apparatus 120 is connected to the central management apparatus 100 over a network so as to communicate with it. The pattern discriminating apparatus 120 functions to discriminate a specific pattern, which will be described later. For example, the pattern discriminating apparatus 120 includes an operating terminal 121, such as a personal computer, and a scanner 122 connected to the operating terminal 121, and the scanner 122 serves to read a specific pattern from an image on a recording medium and the operating terminal 121 serves to discriminate the specific pattern.

Next, the image forming apparatus according to the present embodiment will be described in detail with reference to FIG. 3.

Figure 3:
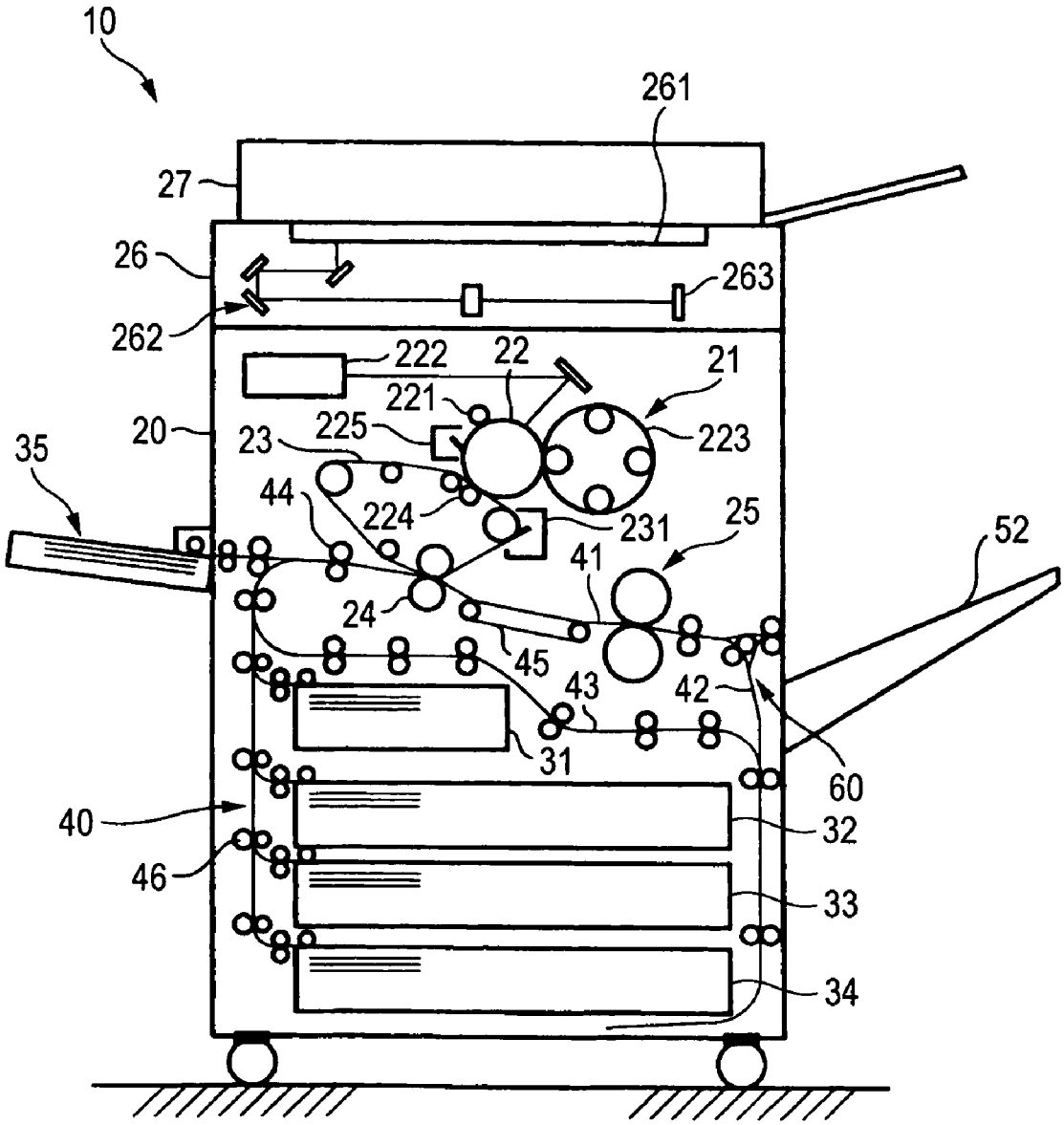
FIG. 3 is an explanatory view illustrating an example of an image forming apparatus used in the first embodiment of the present invention.

In FIG. 3, the image forming apparatus 10 includes a printer unit 20 capable of forming an image on a recording medium (various recording sheets including paper) and a scanner (IIT: Image Input Terminal) 26 provided at the upper side of the printer unit 20 to read an image or a text formed on a recoding medium.

The printer unit 20 has an image generating module 21 in a case thereof, and multi-stage sheet feeding trays 31 to 34 are provided at the lower side of the image generating module 21. In addition, a multi sheet inserter (MSI) 35 is openably provided at the side of the case. Meanwhile, a sheet transfer device 27 to transfer a sheet is provided at the upper side of the scanner 26.

The image generating module 21 used for the present embodiment adopts, for example, an electrophotographic method and includes a photosensitive drum 22 to form and carrying respective color toner images. In the image generating module 21, the respective color toner images on the photosensitive drum 22 are primarily transferred onto an intermediate transfer belt 23 in consecutive order, and then a secondary transfer device 24 composed of, for example, a secondary transfer roll, secondarily transfers the multi-color toner images on the intermediate transfer belt 23 onto a recording sheet. Then, the recording sheet is guided to a fixing unit 25.

Here, devices for electrophotography, such as an electrifying unit 221 to electrify the photosensitive drum 22, an exposure device (raster output scanning optical system) to write an electrostatic latent image on the photosensitive drum 22, such as a laser scanning device, a developing device 223 having the respective color toners therein to visualize the electrostatic latent image on the photosensitive drum 22, a primary transfer device 224 composed of, for example, a transfer roll, to transfer the respective color toner images on the photosensitive drum 22 onto the intermediate transfer belt 23, and a cleaner 225 to clean the remaining toner on the photosensitive drum 22, are sequentially arranged in the vicinity of the photosensitive drum 22.

Further, the intermediate transfer belt 23 is hung by plural hanger rolls so as to circulate, and the secondary transfer device 24 is provided opposite to one hanger roll as a backup roll. In addition, reference numeral 231 indicates a cleaner to clean the intermediate transfer belt 23.

Furthermore, as the fixing unit 25, any of well-known units may be properly selected. For example, a fixing unit can be used in which a heating source, such as a halogen lamp, is provided in a heat fixing roll and a pressure fixing roll comes into press contact with the heat fixing roll by a predetermined pressure force, so that the heat fixing roll and the pressure fixing roll are driven coming into contact with each other, thereby forming a predetermined nip region therebetween.

Moreover, in the present embodiment, a feeding path 40 from the sheet feeding trays 31 to 34 is composed of a main feeding path 41 from the side of the case facing the MSI 35 to a discharging tray 52 through a secondary transfer position of the image generating module 21 and the fixing unit 25, a reverse feeding path 42 provided at the lower side of the vicinity of an outlet of the main feeding path 41 substantially in a Y-shape to reverse a recoding sheet, and a return feeding path 43 connected to a portion of the reverse feeding path 42 to return the reversed recording sheet to the main feeding path 41 in front of the image generating module 21.

Here, a register roll 44 to position and carry the recording sheet is provided on the upstream side of the secondary transfer position of the main feeding path 41, and a transfer belt 45 is provided on the downstream side of the secondary transfer position, to carry the recording sheet to the fixing unit 25. In addition, a proper number of feeding rolls 46 is provided in each feeding path 40. Further, a reverse mechanism 60 to reverse the recording sheet is provided in the reverse feeding path 42.

Figure 4:
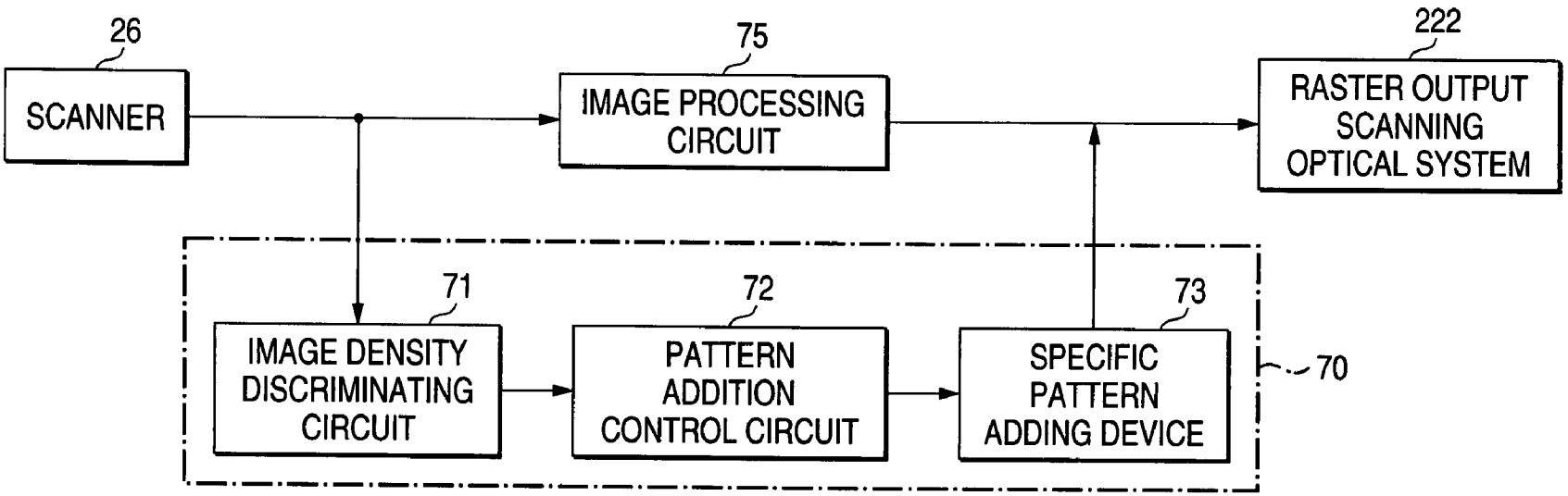
FIG. 4 is an explanatory view illustrating an example of a specific pattern imparting device used in the first embodiment of the present invention.

Furthermore, in the image forming apparatus 10 according to the present embodiment, as shown in FIG. 3, for example, the scanner 26 is configured such that an optical unit 262 reads a document on a platen 261 and an image capturing element 263, such as a CCD, captures it. As shown in FIG. 4, the scanner 26 is connected to an exposure device (raster output scanning optical system) 222 via an image processing circuit 75, and a specific pattern imparting device 70 is provided in parallel to the image processing circuit 75.

In the present embodiment, the specific pattern imparting device 70 functions to impart a specific pattern specifying an image generating job by the image forming apparatus 10 used, and includes an image density discriminating circuit 71 to discriminate the density of an image on the document read by the scanner 26, a pattern addition control circuit 72 to select a specific pattern added so as to be discriminated from the image, based on the image density information output from the image density discriminating circuit 71, and a specific pattern adding device 73 to add a specific pattern based on a control signal from the pattern addition control circuit 72. Further, in the present embodiment, the specific pattern imparting device 70 functions to impart a specific pattern to the output of the scanner 26. Of course, for example, when the image forming apparatus 10 has a read driver to read another recording medium, the specific pattern imparting device 70 may also impart the same specific pattern to another recording medium.

Figure 5A:
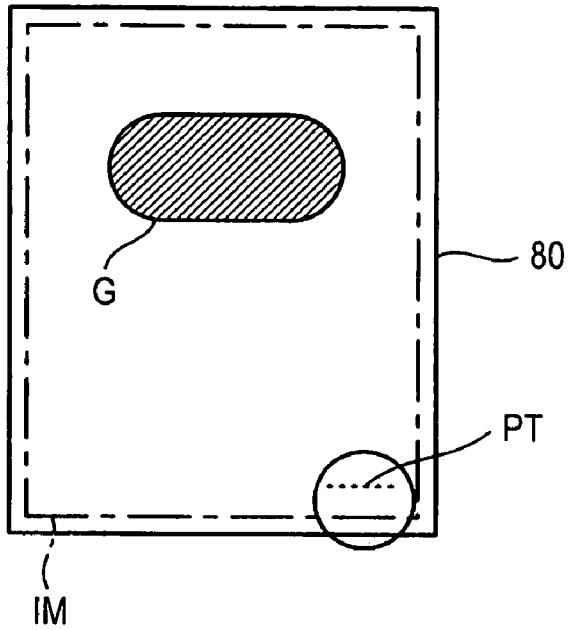
FIG. 5A is an explanatory view illustrating an example of an image on a recording medium formed by the first embodiment.
Figure 5A:
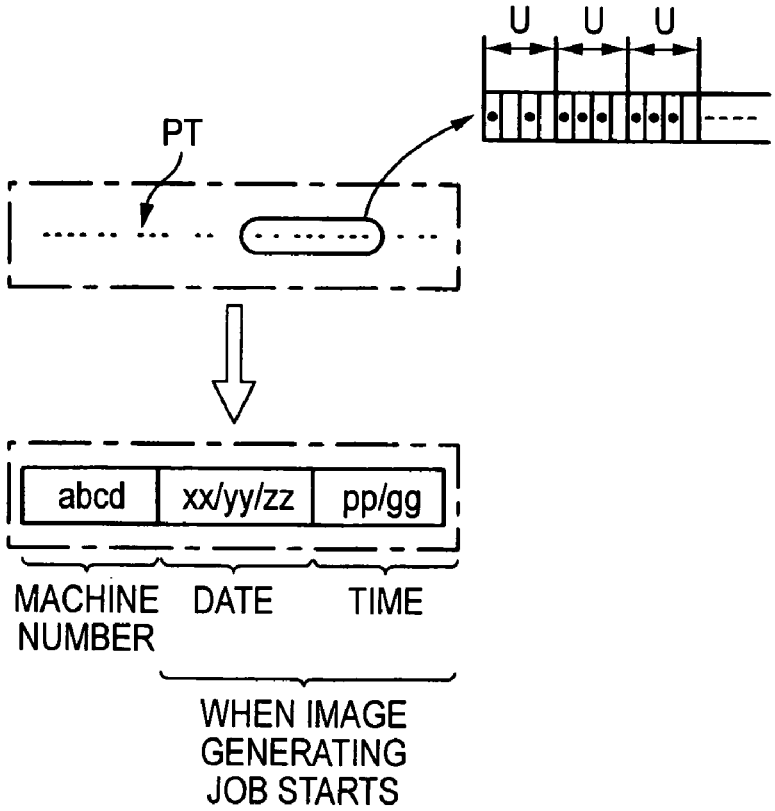

Further to the specific pattern, as shown in FIG. 5A, an image forming region IM in which an image can be formed is provided on a recording sheet 80 with a predetermined margin left at the edge thereof (including no margin), and a specific pattern PT and a general color pixel G are formed in the image forming region IM with them separated from each other.

This specific pattern PT is formed, for example, in the vicinity of one corner of the recording sheet 80. Further, a dot pattern that is not perceived or is hardly perceived by human eyes (for example, a yellow dot pattern difficult to be perceived) is formed as the specific pattern PT.

As shown in FIG. 5B, the specific pattern PT is composed of, for example, a series of 4-bit units U (a hexadecimal number), and the series of 4-bit units includes a machine number (abcd) indicating that a management target is the image forming apparatus 10, and date (xx/yy/zz: for example, Jan. 1, 2004 is indicated in the form of 04/01/01) and time (pp/qq: for example, three thirty p.m. is indicated in the form of 15/30), which are time information when an image generating job starts.

Figure 6:
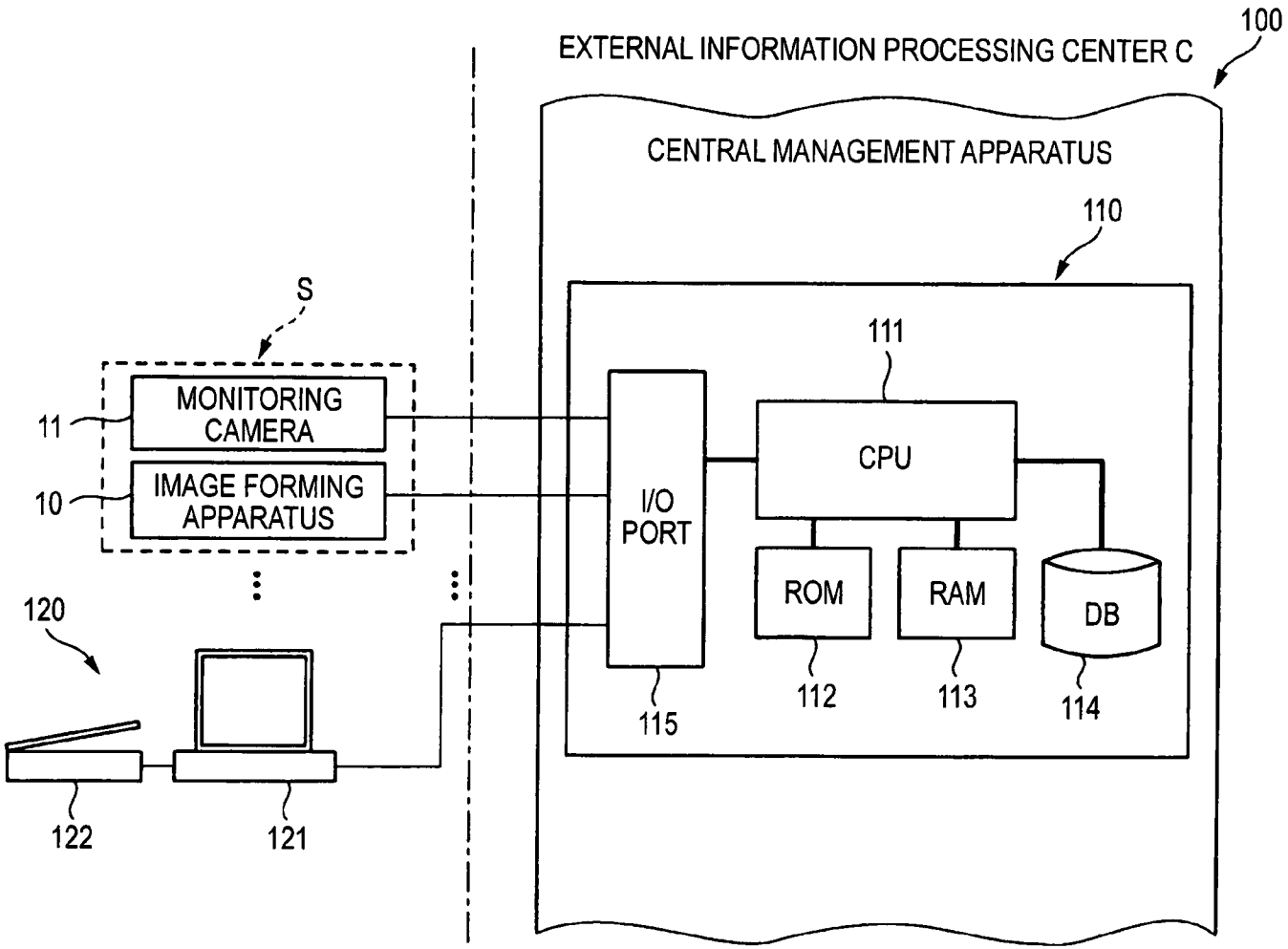
FIG. 6 is an explanatory view illustrating an example of a control device of a central management device used in the first embodiment of the present invention.

Further, as shown in FIG. 6, the central management apparatus 100 of the external information processing center C is composed of a computer system 110 including a CPU 111, a ROM 112, a RAM 113, a hard disk 114 for a database DB, which will be described later, and an I/O port 115.

In the central management apparatus 100, a control program related to a data processing system (a data storing process shown in FIG. 8 or an image data retrieving process shown in FIG. 10B) is previously stored in the ROM 112, and various information from the image forming apparatuses 10 of the respective management target areas S, image data from the monitoring cameras 11, and information from the pattern discriminating apparatus 120 are input to the I/O port 115. Then, the central management apparatus 100 allows the CPU 111 to execute the control program to perform the data storing process and the image data retrieving process.

Next, the operation of the image generation managing system according to the present embodiment will be described.

Figure 7:
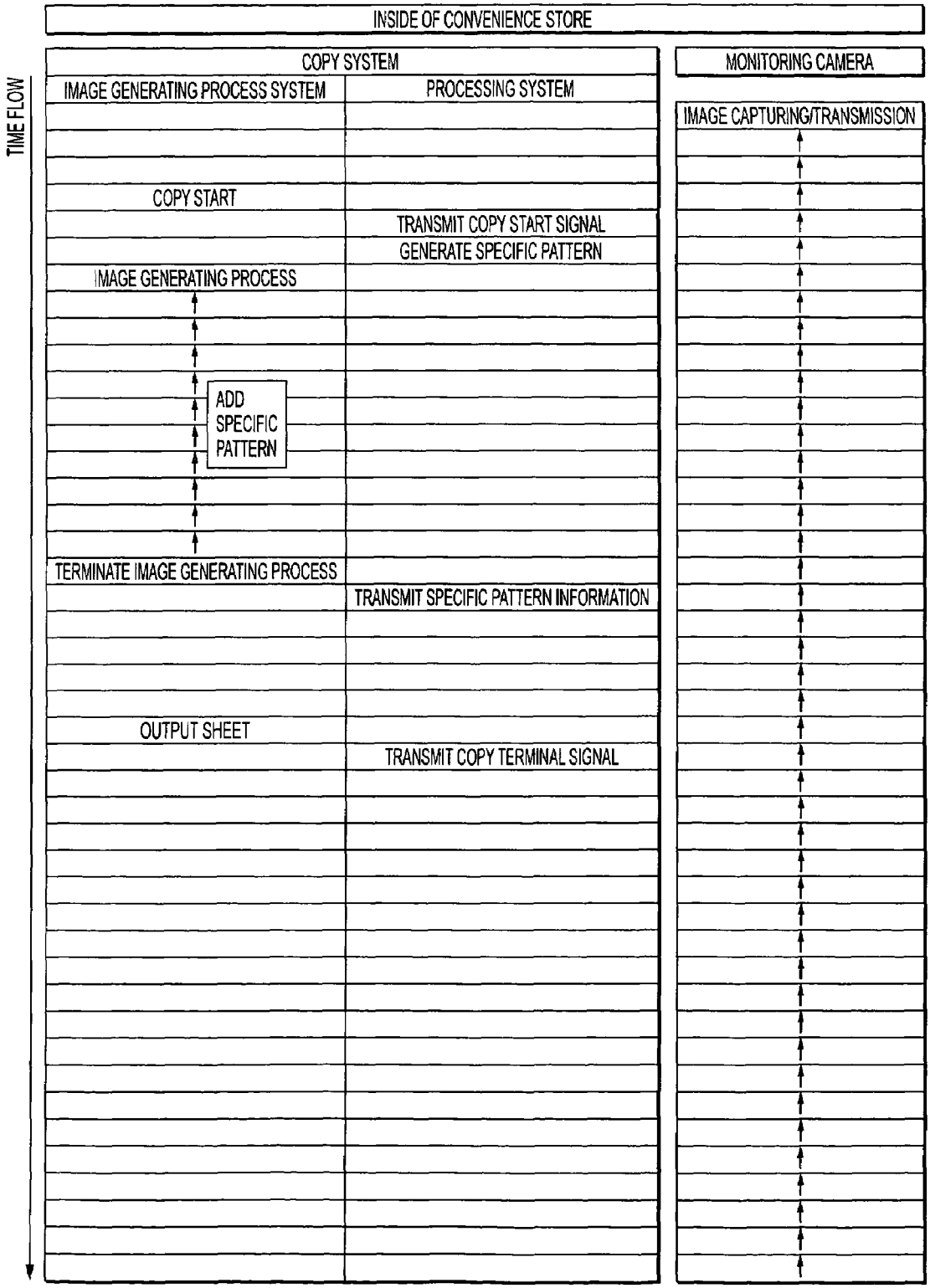
FIG. 7 is an explanatory view illustrating an image generating process system, a process system, and an operating state of a monitoring camera of the image forming apparatus (a duplicating machine) used in the first embodiment.

First, as shown in FIGS. 2 and 7, it is assumed that a user stands in front of the image forming apparatus (duplicating machine) 10 to start an image generating job, for example, in the convenience store, which is the management area S.

Then, the user sets a document on the sheet transfer device 27 of the image forming apparatus 10 and operates a copy button (copy start operation). Then, a series of image forming processes are performed by a copy start signal.

As shown in FIGS. 3 and 4, in this image forming process, the image information of the document read by the scanner 26 is transmitted to the exposure device (raster output scanning optical system) 222 via the image processing circuit 75, and the image generating module 21 using an electrophotographic method forms a color image on a recording sheet. Subsequently, the recording sheet having the image thereon is discharged from the discharging tray 52 through the fixing unit 25.

At that time, since the specific pattern imparting device 70 generates a specific pattern to be transmitted to the exposure device 222, the specific pattern PT shown in FIGS. 5A and 5B as well as a color image corresponding to the document image is formed on the recording sheet.

In such an image generating process, as shown in FIG. 6, the processing system of the image forming apparatus 10 (a processing system by a control device, which is not shown in FIG. 6) transmits a copy start signal, specific pattern information corresponding to the specific pattern PT (for example, as shown in FIG. 5B, information indicated by hexadecimal numbers, such as a machine number, and date and time information when an image generating job starts), and a copy termination signal to the central management apparatus 100 of the external information processing center C.

Meanwhile, the image data captured by the monitoring camera 11 is continuously transmitted to the central management apparatus 100.

Then, the central management apparatus 100 constructs a database DB composed of storage areas shown in FIG. 8 (storage areas 1 to 4) in the hard disk 114.

The central management apparatus 100 consecutively stores the image data (captured moving picture data) from the monitoring camera 11 in the storage area 1 of the database DB.

When receiving the copy start signal from the image forming apparatus 10, the central management apparatus 100 stores the current time (Ta) corresponding to copy start time, for example, in an arbitrary memory (storage area) of the hard disk 114.

When receiving specific pattern information PJ (see FIG. 1) from the image forming apparatus 10, the central management apparatus 100 converts the specific pattern information PJ into an electronic file (A) and stores the file (A) in the storage area 2 of the database DB.

Subsequently, when receiving the copy termination signal from the image forming apparatus 10, the central management apparatus 100 stores the current time (Tb) corresponding to the copy termination time in an arbitrary memory (storage area) of the hard disk 114.

Next, when m seconds elapsed after the reception of the copy termination signal, the central management apparatus 100 acquires captured moving picture data (AV) corresponding to the time from (Ta−n) up to (Tb+m) from the storage area 1. Here, n indicates the time before the copy start signal is received, and m and n indicate the time before and after copy. The values of m and n are properly selected in the range of 0 to 90 seconds.

Further, the central management apparatus 100 compresses the acquired moving picture data (AV), for example, into a file format of an MPEG 2 and stores the compressed file (MP) (hereinafter, referred to as a file (MP) if necessary) in the storage area 3 of the database DB.

Furthermore, the central management apparatus 100 additionally writes association information data indicating the relation between the file (A) related to the specific pattern information PJ and the file (MP) corresponding to the acquired moving picture data (AV) on an association information file (D), which is the storage area 4 of the database DB, and updates and holds the association information file (D).

Here, if the relation between the file (A) related to the specific pattern information PJ and the file (MP) can be specified, any format can be properly selected as the format of the association information data stored in the association information file (D). For example, a text format or a CSV format can be used.

Figure 9:
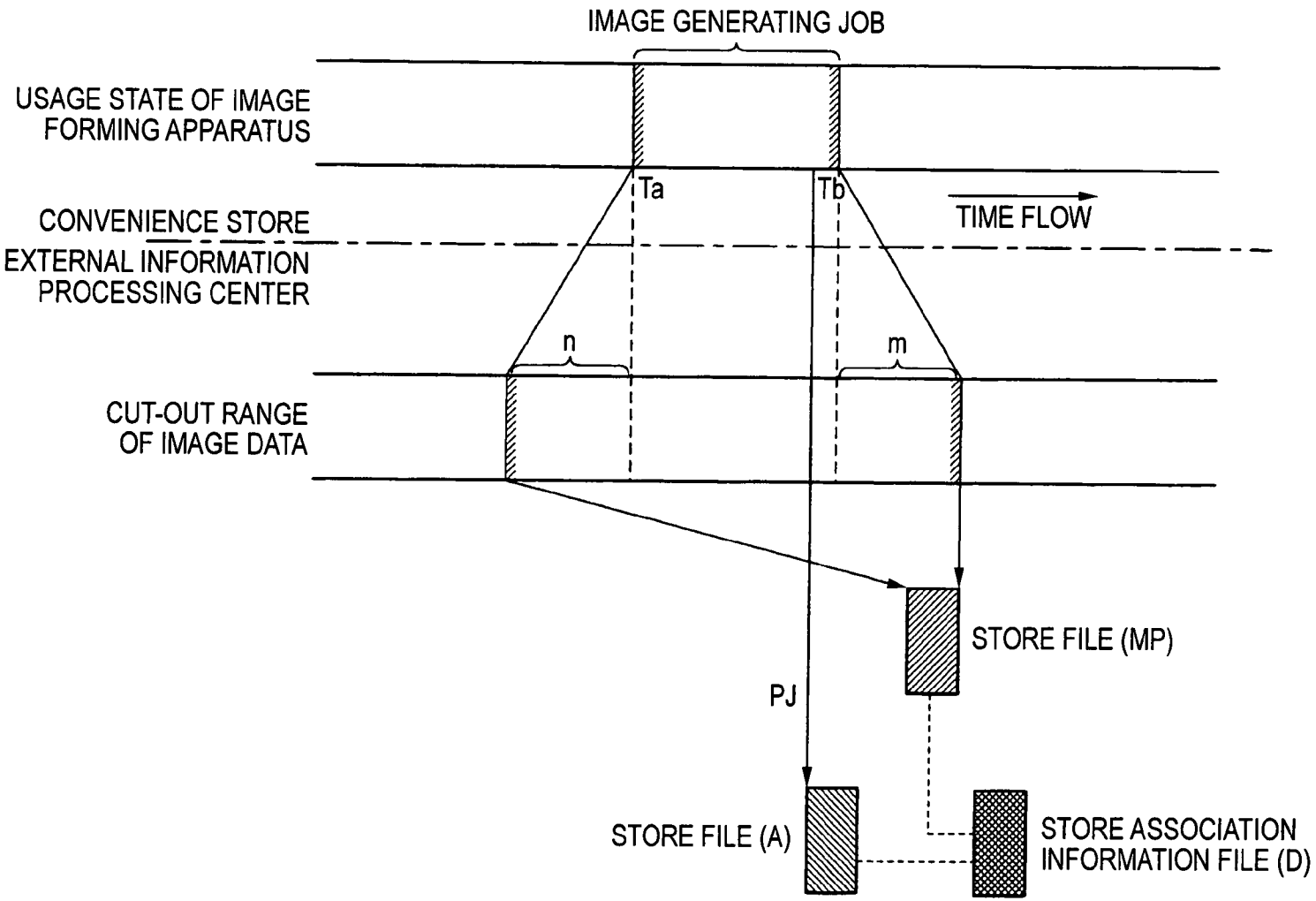
FIG. 9 is an explanatory view schematically illustrating a series of processes of an image generation managing system according to the first embodiment.

The contents of such a series of processes are schematically shown in FIG. 9.

Further, the present embodiment is not limited to the above-mentioned embodiment, but various changes and modifications thereof can be made in design.

For example, in the present embodiment, the captured moving picture data (AV) is stored in the storage area 1 of the database DB. In this case, the captured moving picture data (AV) can always be stored therein. However, in order to effectively use storage capacity, after the file (MP) is stored, the captured moving picture data (AV) of the storage area 1 corresponding to the file (MP) or the captured moving picture data absolutely unrelated to the image generating job by the image forming apparatus 10 may be regularly or irregularly removed.

Furthermore, in the present embodiment, as a storing method of the image data, the captured moving picture data (AV) are acquired when the image forming apparatus 10 is in use and before or after the image forming apparatus 10 is used, but the present embodiment is not limited thereto. For example, only when the image forming apparatus 10 is in use, or, before or after the image forming apparatus 10 is used, the image data may be stored. Alternatively, when the image forming apparatus 10 is in use, the image data may be stored as plural still images.

Next, assuming that recording sheets (recording media), such as counterfeit securities, are found, for example, on the market, the functions of the image generation managing system according to the present embodiment will be described.

The external information processing center C discriminates the specific pattern of the counterfeit recording sheet (recording medium) using the pattern discriminating apparatus 120 connected to the central management apparatus 100.

Figure 10A:
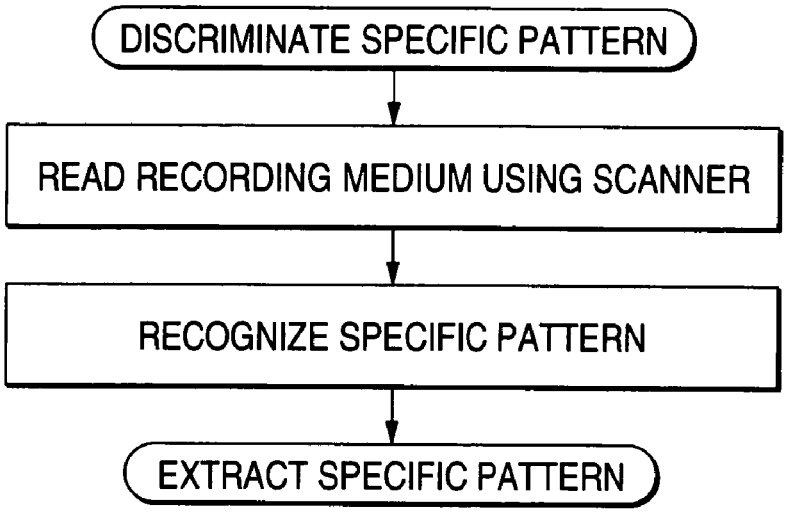
FIG. 10A is an explanatory view illustrating a specific pattern discriminating process performed on an image of a recording medium.

More specifically, as shown in FIG. 10A, the scanner 122 of the pattern discriminating apparatus 120 may read the recording medium, and then the operating terminal 121 may discriminate a specific pattern to extract the specific pattern PT.

According to the above-mentioned process, it is determined that, for example, the specific pattern is PT1.

Figure 10B:
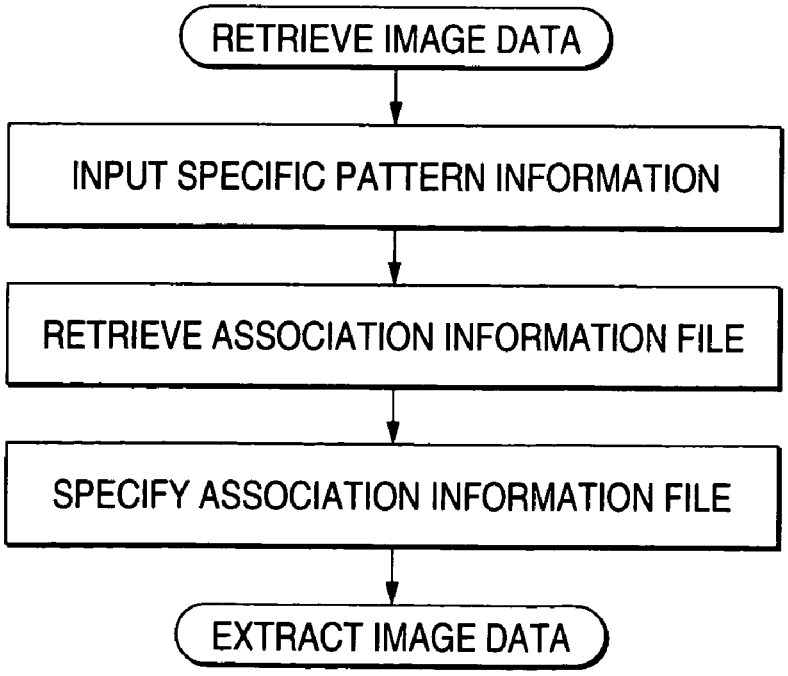
FIG. 10B is an explanatory view illustrating an image data retrieving process.

In this state, the central management apparatus 100 may perform the image data retrieving process shown in FIG. 10B.

First, the image data retrieving process makes it possible to retrieve the association information file (D) by inputting the specific pattern information PJ, to specify the association information data, and to extract the file (MP), which is the association image data, based on the specified association information data. It is apparently understood the situation corresponding to the image generating job to which the specific pattern PT is imparted, by reading the extracted image data, and it is possible to specify a user using the image forming apparatus 10 for an improper purpose, based on the image data.

Second Embodiment

Figure 11A:
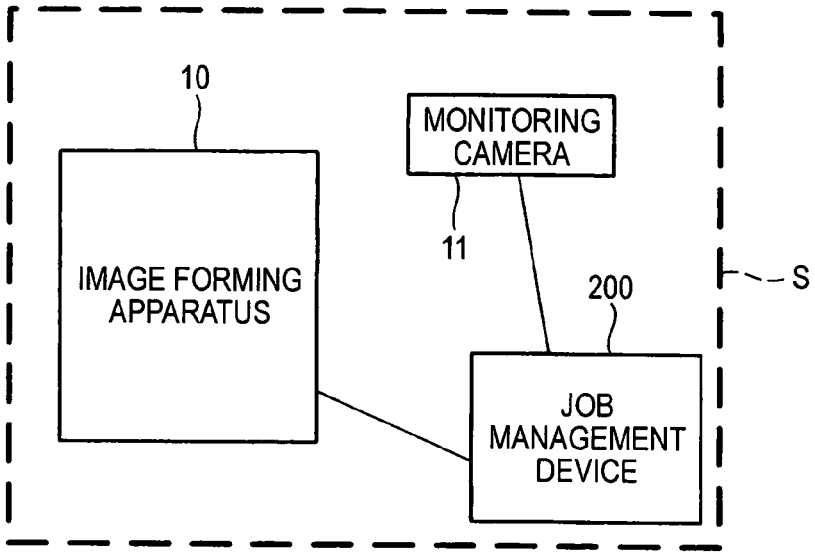
FIG. 11A is an explanatory view illustrating a second embodiment of the image generation managing system according to the present invention.

FIG. 11A illustrates a second embodiment of the image generation managing system according to the present invention.

In FIG. 11A, the basic structure of the image generation managing system is the same as that in the first embodiment except that a job management apparatus 200 is provided in each management target area S (for example, the convenience store), instead of the central management apparatus 100 of the external information processing center C, to manage the image generating job of the image forming apparatus 10 in the management target area S.

In this case, for example, when a counterfeit document is found on the market, the specific pattern information PJ recorded on the counterfeit document may be notified for a responsible person to manage the image generating job of the image forming apparatus 10 in each management target area S.

Figure 11B:
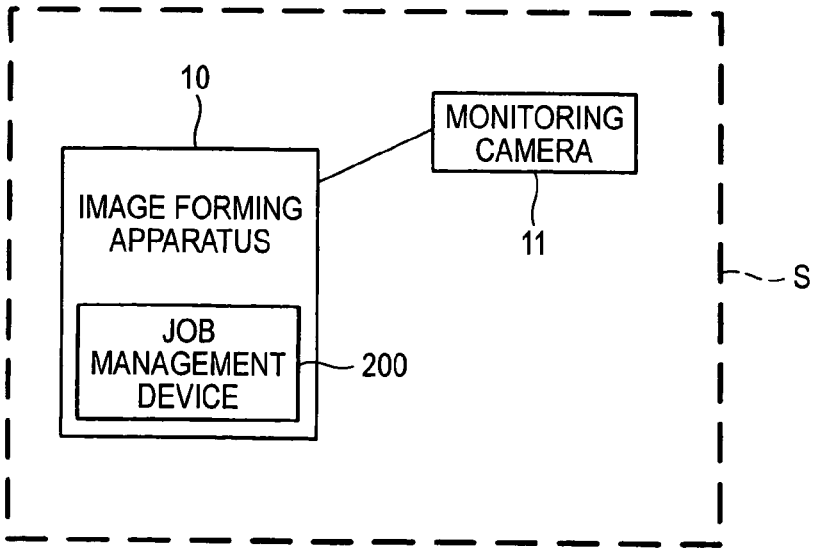
FIG. 11B is an explanatory view illustrating a modification of the image generation managing system.

Further, in the present embodiment, the job management apparatus 200 is provided separately from the image forming apparatus 10. However, as shown in FIG. 11B, for example, the job management apparatus 200 may be incorporated into the image forming apparatus 10.

The entire disclosure of Japanese Patent Application No. 2004-077090 filed on Mar. 17, 2004 including specification, claims, drawings and abstract is incorporated herein by reference in its entirety.

What is claimed is:

1. An image generation managing system comprising:

an image forming apparatus provided in a management target area, to form a color image on a recording medium;

an image capturing apparatus to capture an image in a vicinity of the image forming apparatus in the management target area; and a job management device connected to the image forming apparatus and the image capturing apparatus over a network to data-communicate therewith, to manage an image generating job by the image forming apparatus, wherein the image forming apparatus includes a specific pattern imparting unit to impart a specific pattern specifying an image formed for each image generating job by the image forming apparatus, the job management device includes a database in which specific pattern information imparted to the image by the specific pattern imparting unit and image data captured by the image capturing apparatus are stored in a state in which they can be associated with each other and from which the stored information is freely retrieved, and the image data captured by the image capturing apparatus is obtained by photographing the image forming apparatus and a vicinity thereof.

2. The image generation managing system according to claim 1, wherein the job management device unitarily manages the image generating jobs by a plurality of image forming apparatuses respectively provided in a plurality of management target areas.

3. The image generation managing system according to claim 1, wherein the database of the job management device is stored with the image data and the specific pattern information of the image in a state in which they have been previously associated with each other.

4. The image generation managing system according to claim 1, further comprising:

a pattern discriminating apparatus to discriminate the specific pattern added to an image on the recording medium, wherein the job management device retrieves the database based on the specific pattern discriminated by the pattern discriminating apparatus.

5. The image generation managing system according to claim 1, wherein the specific pattern imparted by the specific pattern imparting unit is a dot pattern which is not perceived or hardly perceived by human eyes.

6. The image generation managing system according to claim 1, wherein the different specific patterns imparted by the specific pattern imparting unit are respectively added to the output images from all the image forming apparatuses which are management targets.

7. The image generation managing system according to claim 1, wherein the specific pattern imparted by the specific pattern imparting unit includes source information specifying the image forming apparatus in use and time information specifying the time of the image generating job.

8. The image generation managing system according to claim 1, wherein a plurality of image capturing apparatuses is provided with respect to one image forming apparatus in the management target area.

9. The image generation managing system according to claim 1, wherein the image data captured by the image capturing apparatus includes the image data captured when the image forming apparatus is in use.

10. The image generation managing system according to claim 1, wherein the image data captured by the image capturing apparatus includes the image data captured before or after the image forming apparatus is used.

11. The image generation managing system according to claim 1, wherein the job management device stores the image data captured by the image capturing apparatus in the database in a compressed file format.

12. The image generation managing system according to claim 1, wherein the job management device determines a storage range of the image data captured by the image capturing apparatus, based on the image generation start timing of the image forming apparatus.

13. The image generation managing system according to claim 1, wherein the job management device stores necessary files of the image data in the database and then removes the unnecessary image data from the database.

14. The image generation managing system according to claim 3, wherein the database of the job management device stores a file name of the image data and the specific pattern information of the image in connection with each other to discriminate the image data.

15. The image generation managing system according to claim 3, wherein the database of the job management device stores information which associates the specific pattern information of the image with the image data.

16. The image generation managing system according to claim 1, wherein the job management device is incorporated into the image forming apparatus.

* * * * *